US005283983A

United States Patent [19]

Lazarou

[11] Patent Number: 5,283,983

[45] Date of Patent: Feb. 8, 1994

[54] SHARPENING DEVICE

[76] Inventor: Jim Lazarou, Lot 1 Killara Road, Cowra, New South Wales, 2794, Australia

[21] Appl. No.: 898,408

[22] Filed: Jun. 15, 1992

[51] Int. Cl.[5] ..... B24D 7/02; B24D 7/10

[52] U.S. Cl. ..... 51/209 R; 51/356; 51/267

[58] Field of Search ..... 51/209 R, 173, 170 T, 51/109 BS, 267, 281 SF, 209 DL, 213

[56] References Cited

U.S. PATENT DOCUMENTS

| | | | |
|---|---|---|---|
| 928,755 | 7/1909 | Henderson | 51/109 R |
| 2,496,352 | 2/1950 | Metzger et al. | 51/209 R |
| 2,697,878 | 12/1954 | Oberley | 51/267 |
| 3,153,885 | 10/1964 | Keller et al. | 51/267 |
| 3,680,264 | 8/1972 | Dewitt | 51/209 R |
| 3,928,946 | 12/1975 | Wynn | 51/109 R |
| 4,114,322 | 9/1978 | Greenspan | 51/209 R |

FOREIGN PATENT DOCUMENTS 2450284 2/1984 Australia .

5592890 11/1990 Australia .

OTHER PUBLICATIONS

"Introducing the Router Bit Sharpener" (no date, no author listed).

*Primary Examiner*—Bruce M. Kisliuk
*Assistant Examiner*—Bryan Reichenbach
*Attorney, Agent, or Firm*—Michael D. Bednarek

[57] ABSTRACT

A rotatable sharpening device which includes a mounting shaft, and a sharpening head integral with the mounting shaft and having a disc-like sharpening face distal from and co-axial with the mounting shaft. The sharpening head is substantially in the form of a shallow frusto-cone having a base coated with fine particles of diamond to constitute the sharpening face, and having a chamfered rim portion adjacent the sharpening face. The upper surface of the sharpening head is shaped to allow lubricating fluid to lubricate a workpiece by flowing along the upper surface to the edge of the sharpening face.

12 Claims, 3 Drawing Sheets

SHARPENING DEVICE

TECHNICAL FIELD

This invention relates to a sharpening device.

This invention has particular but not exclusive application to a sharpening device which may be used for sharpening router bits and the like and for illustrative purposes reference will be made to such application. However it will be understood that this invention could be used in other applications where sharpening is required. Examples of alternative uses include sharpening drill bits, saw blades, knives, chisels and other hand tools.

BACKGROUND OF THE INVENTION

The diamond coating of sharpening and cutting tools is known. These tools include saw blades for cutting masonry, files of many sizes and shapes used in patternmaking and machining, and honing stones which can vary in size from small pocket size for sharpening points on articles such as fish hooks to much larger honing stones for honing planer blades etc. Known sharpening tools may be made of plastic with the diamond rolled into the surface. Other sharpening tools have the diamond surface formed on an alloy base which is usually relatively thin and mounted onto a timber block for support. These known sharpening tools lack the strength and rigidity necessary for accurate grinding operations. It is sometimes necessary for tools such as drill and router bits to be reshaped by a grinding operation prior to being edge-sharpened by honing. Known sharpening tools are mostly ineffective for both grinding and honing.

Some router bits have concave cutting faces and are difficult to sharpen with a flat or straight edged stone which cannot reach into the concavity of the cutting face. Furthermore known sharpening tools are mostly inadequate for sharpening the bottom or plunging edge of a router cutter.

My Australian application no. 55928/90 addresses these problems and provides a sharpening device having an elongated mounting shaft and a disk-like sharpening head integral therewith at one end thereof, the distal surface of the sharpening head being coated with a fine layer of diamond particles to form a sharpening face. The tool is effective in overcoming many of the disadvantages outlined above but still has a number of disadvantages.

In particular, it has been found that when grinding with the sharpening device held in a drill positioned downwardly, it is difficult to ensure that lubricating fluid lubricates the workpiece which is obscured by the sharpening head. In use, as the sharpening device rotates, the lubricating fluid is spun outwardly over the substantially horizontal upper surface of the disc-like sharpening head and is flung off at the unction of the upper surface and the edge of the sharpening head. Furthermore because the edge portion of the disc-like sharpening head is relatively thick, the sharpening face is unable to enter a surface having a low or angled overhang and accordingly router bits having such surfaces cannot be effectively sharpened with the sharpening device of 55928/90.

The present invention aims to alleviate the above disadvantages and to provide a support assembly which will be reliable and efficient in use. Other objects and advantages of this invention will hereinafter become apparent.

SUMMARY OF INVENTION

With the foregoing and other objects in view this invention in one aspect resides broadly in a rotatable sharpening device including:

a mounting shaft, and a sharpening head integral with the mounting shaft and having a disc-like sharpening face distal from and co-axial with the mounting shaft;

the sharpening head being substantially in the form of a shallow frusto-cone having a base coated with fine hard particles to constitute the sharpening face, and having a chamfered rim portion extending rearwardly of the sharpening face.

Preferably the particles are diamond particles but could be carborundum or the like if desired.

It is preferred that the included angle between the frusto-conical surface of the frusto-cone and the chamfered rim portion allows lubricating fluid to lubricate a workpiece by flowing along the upper surface of the sharpening head to the edge of the sharpening face. Suitably the included angle between the frusto-conical surface and the chamfered rim portion is greater than 135°. It is preferred that the included angle between the frusto-conical surface and the chamfered rim portion is between 135° and 165° and in a preferred embodiment is approximately 150°.

It is also preferred that the axial depth of the chamfered rim portion is such as will provide sufficient strength to the edge of the sharpening surface to prevent chipping and fragmenting when sharpening at regular rotational speeds whilst permitting the entry of the sharpening face to sharpen cutting faces having a low or angled overhang. The axial depth of the chamfered rim portion is suitably between 0.5 and 3.5 millimeters and is preferably approximately 2 millimeters and the sharpening face has a diameter of between 35 and 70 millimeters.

Preferably the included angle between a projection of the frusto-conical surface and the sharpening surface is between 5° and 40° and is suitably approximately 20° and the sharpening surface has a diameter of between 45 and 50 millimeters. The frusto-conical surface may be formed to have a radiussed junction with the mounting shaft. The shoulder formed at the junction between the frusto-conical surface and the chamfered rim portion ca also be radiussed.

DESCRIPTION OF DRAWINGS

In order that this invention may be more readily understood and put into practical effect, reference will now be made to the accompanying drawings which illustrate a preferred embodiment of the invention, wherein.

DETAILED DESCRIPTION OF PREFERRED EMBODIMENT

Figure 1:
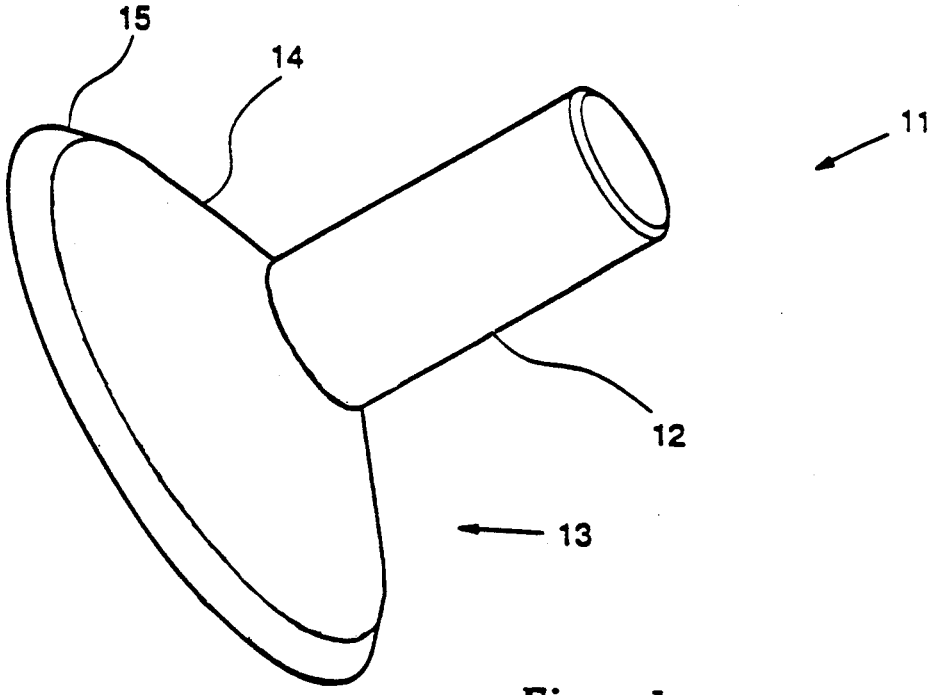
FIGS. 1 and 2 are perspective views from above and below of the sharpening device.

As can be seen in the illustrations, the sharpening device 11 has a longitudinally extending mounting shaft 12 and a sharpening head 13. The sharpening head 13 is machined to provide a pair of frusto-conical surfaces 14 and 15, frusto-conical surface 15 forming an outer chamfered rim to the sharpening head. The sharpening head 13 thus takes the form of a shallow frusto-cone extending to a relatively narrow chamfered rim portion.

Figure 2:
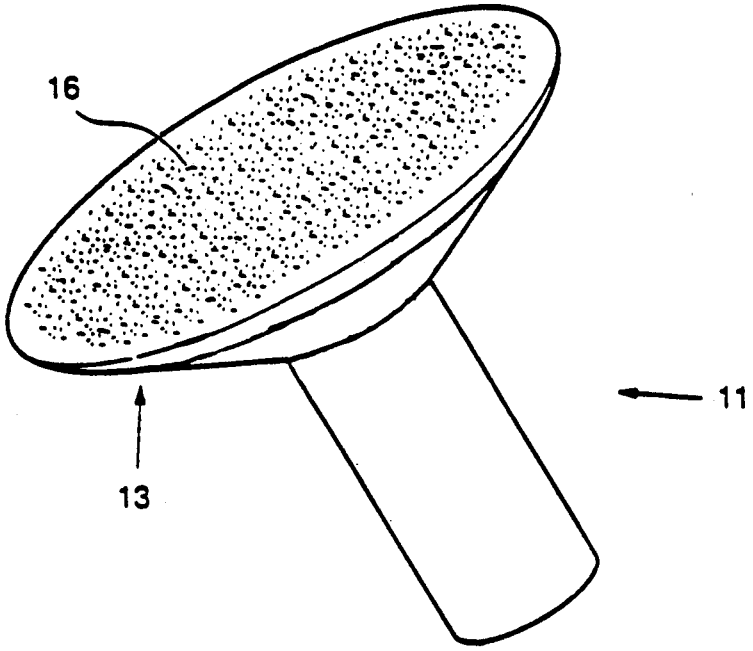

As can best seen in FIG. 2 the end face of the sharpening head 13 is in the form of a planar disc 16 which is covered with fine diamond particles to form a sharpening face suitable for both honing and grinding operations.

The included angle between the projection of the frusto-conical surface 14 and the sharpening face 16 is approximately 20° and the included angle between the frusto-conical surface 14 and the chamfered rim portion 15 is approximately 150°. The axial depth of the chamfered rim portion is approximately 2 millimeters and the sharpening surface has a diameter of approximately 47 millimeters.

Figure 3:
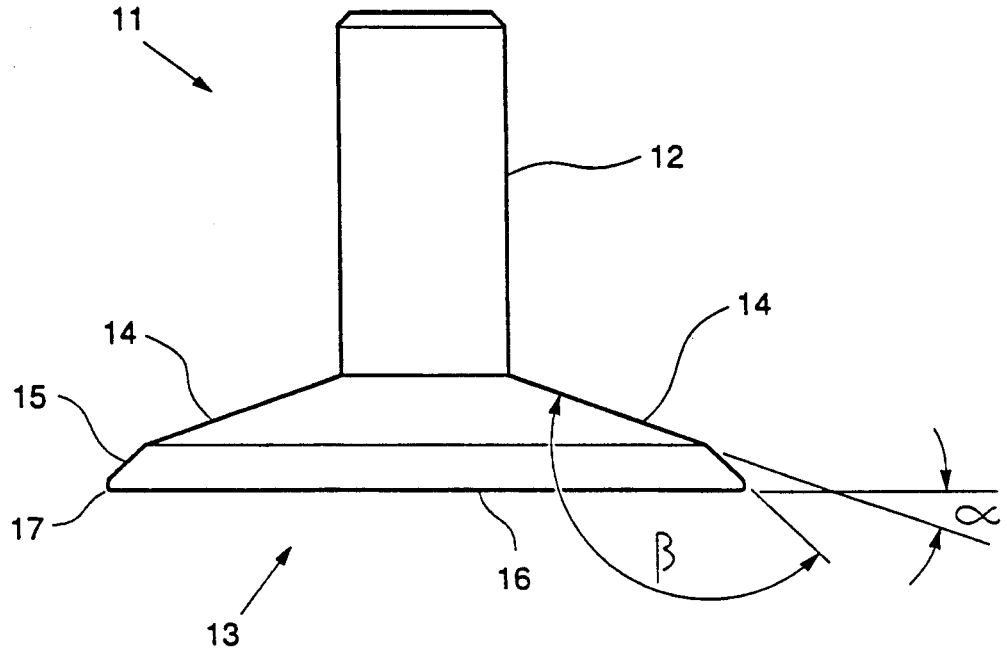
FIG. 3 is a side elevation view of the sharpening device.

The included angle a between the frusto-conical surface 14 and the chamfered rim portion 15, and the included angle $\beta$ between the chamfered rim portion 15 and the sharpening surface 16, as illustrated in FIG. 3, are so configured that lubricating fluid placed on the shaft 12 during operation will flow across both surfaces 14 and 15 to the edge of the sharpening surface 16 from where it may be transferred to the workpiece. In the preferred embodiment illustrated the angle $\alpha$ is 150° and the angle $\beta$ is 20°.

Figure 4:
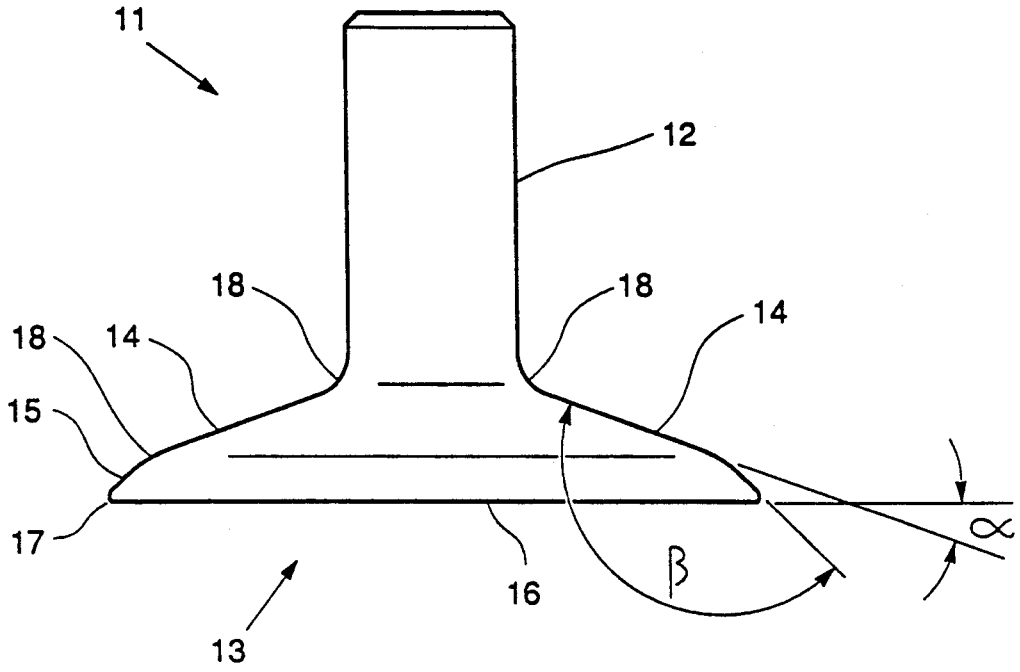
FIG. 4 is a side elevating view of a sharpening device in which the shoulders are radiussed.

As can be seen in FIG. 4, the shoulders can also be radiussed instead of angled to provide a profile effective to allow lubricating fluid to lubricate a workpiece by flowing along the upper surface of the sharpening head to the edge of the sharpening face.

The diamond particles are coated to the surface by an electro bonding process in which the diamond particles are in solution with nickel chrome.

While the sharpening device 11 in accordance with this invention is specifically adapted for rotary grinding, the device can be used as a hone. It may be used for honing by fixing the mounting shaft 12 in a vice so that sharpening face 16 is fixed in a position to be accessible for honing knives, router bits, masonry drills, planar knives etc. Alternatively, the sharpening device 11 can be hand-held by the mounting shaft and tools can be honed by hand.

The sharpening device can be used to grind articles by being secured in a drill chuck or the like which may be supported in a drill stand.

It will be appreciated that the sharpening device in accordance with this invention enables surfaces to be lubricated while being ground by allowing lubricant to flow over the upper surface of the sharpening head to the edge of the sharpening surface from where it may be transferred to the workpiece as the sharpening surface is brought into contact with the workpiece. The sharpening device also enables previously inaccessible faces of router bits and the like to be sharpened because the edge 17 of the sharpening device is relatively fine. The sharpening surface 16 can also enter normally inaccessible areas such as the mounted blade of a planing machine which can be sharpened in-situ.

The sharpening device can be used by hand to hone long sharp edges such as those used in planing machines. Because the blades can be sharpened in-situ the requirement to use large diamond stones or expensive blade-holding jigs to sharpen the blades is eliminated. This also avoids the necessity of resetting the blades after sharpening.

It will of course be realised that whilst the above has been given by way of an illustrative example of this invention, all such and other modifications and variations hereto, as would be apparent to persons skilled in the art, are deemed to fall within the broad scope and ambit of this invention as is hereinafter claimed.

I claim:

1. A rotatable sharpening device including:

a mounting shaft, and a sharpening head integral with said mounting shaft and having a sharpening face with an edge, the sharpening face being distal from said mounting shaft;

said sharpening head being substantially in the form of a shallow frusto-cone having a frusto-conical surface and a base coated with fine hard particles to constitute said sharpening face with an edge, and having a chamfered rim portion extending between said sharpening face and the frusto-conical surface of said frusto-cone, the chamfered rim portion having a surface, a longitudinal axis and an axial depth;

wherein the included angle between said frusto-conical surface and said chamfered rim portion is between 135° and 165° and the included angle between a projection of said frusto-conical surface and said sharpening face is between 5° and 40° such that, in use, lubricating fluid can lubricate a workpiece by flowing across said frusto-conical surface and the surface of said chamfered rim portion to the edge of said sharpening face.

2. A sharpening device as claimed in claim 1, wherein said particles are diamond particles.

3. A sharpening device as claimed in claim 1, wherein said included angle between said frusto-conical surface and said chamfered rim portion is approximately 150°.

4. A sharpening device as claimed in claim 1, wherein said included angle between a projection of said frusto-conical surface and said sharpening face is approximately 20°.

5. A sharpening device as claimed in claim 4, wherein the axial depth of said rim portion is substantially between 0.5 and 3.5 millimeters and a diameter of the sharpening face is between 35 and 70 millimeters.

6. A sharpening device as claimed in claim 5, wherein said axial depth of said rim portion is approximately 2 millimeters and the diameter of the sharpening face is between 45 and 50 millimeters.

7. A rotatable sharpening device including:

a mounting shaft, and a sharpening head integral with said mounting shaft, the sharpening head being substantially in the form of a shallow frusto-cone having a frusto-conical surface, a planar base and a frusto-conical chamfered rim portion extending between said planar base and the frusto-conical surface of said frusto-cone; the planar base being coated with fine hard particles to constitute a planar sharpening face; wherein the frusto-conical surface and the frusto-conical chamfered rim portion contact each other such that the included angle between the frusto-conical surface and the frusto-conical chamfered rim portion is between 135° and 165° and the included angle between a projection of said frusto-conical surface and said sharpening face is between 5° and 40°.

8. A sharpening device as claimed in claim 7, wherein said particles are diamond particles.

9. A sharpening device as claimed in claim 7, wherein said included angle between said frusto-conical surface and said chamfered rim portion is approximately 150°.

10. A sharpening device as claimed in claim 7, wherein said included angle between a projection of said frusto-conical surface and said sharpening face is approximately 20°.

11. A sharpening device as claimed in claim 10, wherein the rim portion has a longitudinal axis and an axial depth and wherein the axial depth of said rim portion is substantially between 0.5 and 3.5 millimeters and a diameter of the sharpening face is between 35 and 70 millimeters.

12. A sharpening device as claimed in claim 11, wherein said axial depth of said rim portion is approximately 2 millimeters and the diameter of the sharpening face is between 45 and 50 millimeters.

* * * * *